US005891285A

United States Patent [19]

Nakayama

[11] Patent Number: 5,891,285

[45] Date of Patent: Apr. 6, 1999

[54] PROCESS FOR MANUFACTURING ELECTROFORMED PATTERNS

[75] Inventor: Hajime Nakayama, Yokosuka, Japan

[73] Assignee: Tefco International Co., Ltd., Japan

[21] Appl. No.: 853,106

[22] Filed: May 8, 1997

[30] Foreign Application Priority Data

May 10, 1996 [JP] Japan ..... 8-116615

[51] Int. Cl.[6] ..... C25D 1/00

[52] U.S. Cl. ..... 156/150; 156/235; 156/249; 205/67; 205/72

[58] Field of Search ..... 205/67, 70, 72, 205/79; 156/150, 235, 249

[56] References Cited

U.S. PATENT DOCUMENTS

| | | | |
|---|---|---|---|
| 4,462,873 | 7/1984 | Watanabe | 156/150 |
| 4,584,039 | 4/1986 | Shea | 156/150 |
| 4,869,760 | 9/1989 | Matsunami | 156/151 |
| 5,501,785 | 3/1996 | Nakayama | 205/67 |

FOREIGN PATENT DOCUMENTS

| | | | |
|---|---|---|---|
| 26 04 390 | 8/1976 | Germany | 205/72 |
| 57-054068 | 3/1982 | Japan . | |
| 58-33909 | 2/1983 | Japan . | |
| 60-011568 | 1/1985 | Japan . | |
| 60-196956 | 10/1985 | Japan . | |
| 61-56264 | 12/1986 | Japan . | |
| 3107496 | 5/1991 | Japan . | |

*Primary Examiner*—Kathryn Gorgos
*Assistant Examiner*—William T. Leader
*Attorney, Agent, or Firm*—Webb Ziesenheim Bruening Logsdon Orkin & Hanson, P.C.

[57] ABSTRACT

A process for manufacturing electroformed patterns includes the following steps: forming electroformed closed line graphic patterns and an electroformed line surrounding said patterns (optionally together with an electroformed island) on a surface of a conductive substrate; peeling the electroformed patterns and the electroformed line (optionally together with the electroformed island) from the conductive substrate to transfer them onto a pressure-sensitive adhesive layer provided on a support; injecting or printing a coating material inside the closed line graphic electroformed patterns and converting the coating material to coating films; forming a firmly bonding adhesive layer on a whole surface of the support on its side where the electroformed patterns, the coating films and the electroformed line (optionally together with the electroformed island) are retained; removing the electroformed line (optionally together with the electroformed island); separating the electroformed patterns and the coating films from the support and, simultaneously therewith, adhering the electroformed patterns and coating films through the firmly bonding adhesive layer onto a surface of an adherend. This process enables simple formation of electroformed patterns provided with coating films which may be a luminous paint, and is suitable for making a timepiece face.

12 Claims, 7 Drawing Sheets

PROCESS FOR MANUFACTURING ELECTROFORMED PATTERNS

FIELD OF THE INVENTION

The present invention relates to a process for manufacturing electroformed patterns in which patterns such as time indicating marks or letters for timepieces and ornamental parts are formed by the electroforming technique and provided with coating films formed from, for example, a luminous paint in a series of forming steps and in which the patterns (electroformed patterns) and the coating films are simultaneously transferred onto a support such as a film and then adhered to an adherend such as a timepiece display plate.

BACKGROUND OF THE INVENTION

Recently, electroformed patterns obtained by electrodepositing a metal are widely employed in the formation of patterns with extremely fine and complex shapes, e.g., letters for timepieces or ornamental parts.

For example, the timepiece dial or pointer may be provided with a coating material (e.g., luminous paint) by coating or printing in order to improve the visibility thereof. The adherence of the coating material per se is generally poor, so that a surface to be provided with the coating material must be treated with a primer prior to the application of the coating material. This complicates the process.

After the application of the luminous paint, for ornamentation, the above electroformed patterns may be adhered onto the timepiece dial or pointer. In that event, strict positioning is required at the application of the electroformed patterns for preventing dislocations of the coating film and the electroformed patterns. This further complicates the process.

Therefore, if the primer treatment or other pretreatment of the surface to be provided with a coating material can be rendered unnecessary and if the coating film and the electroformed patterns can simultaneously be transferred onto an adherend, these would enable simplification of the process to a conspicuous processing advantage.

The present invention has been made taking the above prior art problem into account. Thus, an object of the present invention is to provide a process for manufacturing electroformed patterns by which electroformed patterns provided with coating films can be formed through simple operation.

SUMMARY OF THE INVENTION

The above object has been attained by the first process for manufacturing electroformed patterns according to the present invention, which comprises:

forming electroformed closed line graphic patterns and an electroformed line surrounding the above patterns on surface of a conductive substrate, peeling the electroformed patterns and the electroformed line from the conductive substrate to transfer them onto a pressure-sensitive adhesive layer provided on a support, injecting or printing a coating material inside the closed line graphic electroformed patterns and converting the coating material to coating films, forming a firmly bonding adhesive layer on a whole surface of the support on its side where the electroformed patterns, the coating films and the electroformed line are retained, removing the electroformed line, separating the electroformed patterns and the coating films from the support and, simultaneously therewith, adhering the electroformed patterns and coating films through the firmly bonding adhesive layer onto a surface of an adherend.

Also, the above object has been attained by the second process for manufacturing electroformed patterns according to the present invention, which comprises:

forming electroformed closed line graphic patterns, an electroformed line surrounding the above patterns and an electroformed island arranged at an area other than that of the above electroformed patterns, the above electroformed island being surrounded by and interlinked to the above electroformed line, on a surface of a conductive substrate, peeling the electroformed patterns, the electroformed line and the electroformed island from the conductive substrate to transfer them onto a pressure-sensitive adhesive layer provided on a support, injecting or printing a coating material inside the closed line graphic electroformed patterns and converting the coating material to coating films, forming a firmly bonding adhesive layer on a whole surface of the support on its side where the electroformed patterns, the coating films, the electroformed line and the electroformed island are retained, removing the electroformed line and the electroformed island, separating the electroformed patterns and the coating films from the support and, simultaneously therewith, adhering the electroformed patterns and coating films through the firmly bonding adhesive layer onto a surface of an adherend.

In the present invention, it is preferred that the conductive substrate comprise a metallic plate and a conductive thin film provided thereon.

Further, the pressure-sensitive adhesive layer is preferred to comprise an ultraviolet-curing type pressure-sensitive adhesive.

Still further, it is preferred that the coating material injected or printed inside the closed line graphic of the electroformed patterns be a luminous paint.

DETAILED DESCRIPTION OF THE INVENTION

First and second embodiments of the present invention will be described in detail hereinbelow with reference to the attached drawings.

In the first embodiment, time indicating marks for timepieces are adhered as electroformed patterns to a surface of a timepiece display plate (adherend). However, this invention is in no way limited to manufacturing of the time indicating marks for timepieces, and can be applied to manufacturing of various letters, ornamental letters, symbols, etc.

Figure 1:
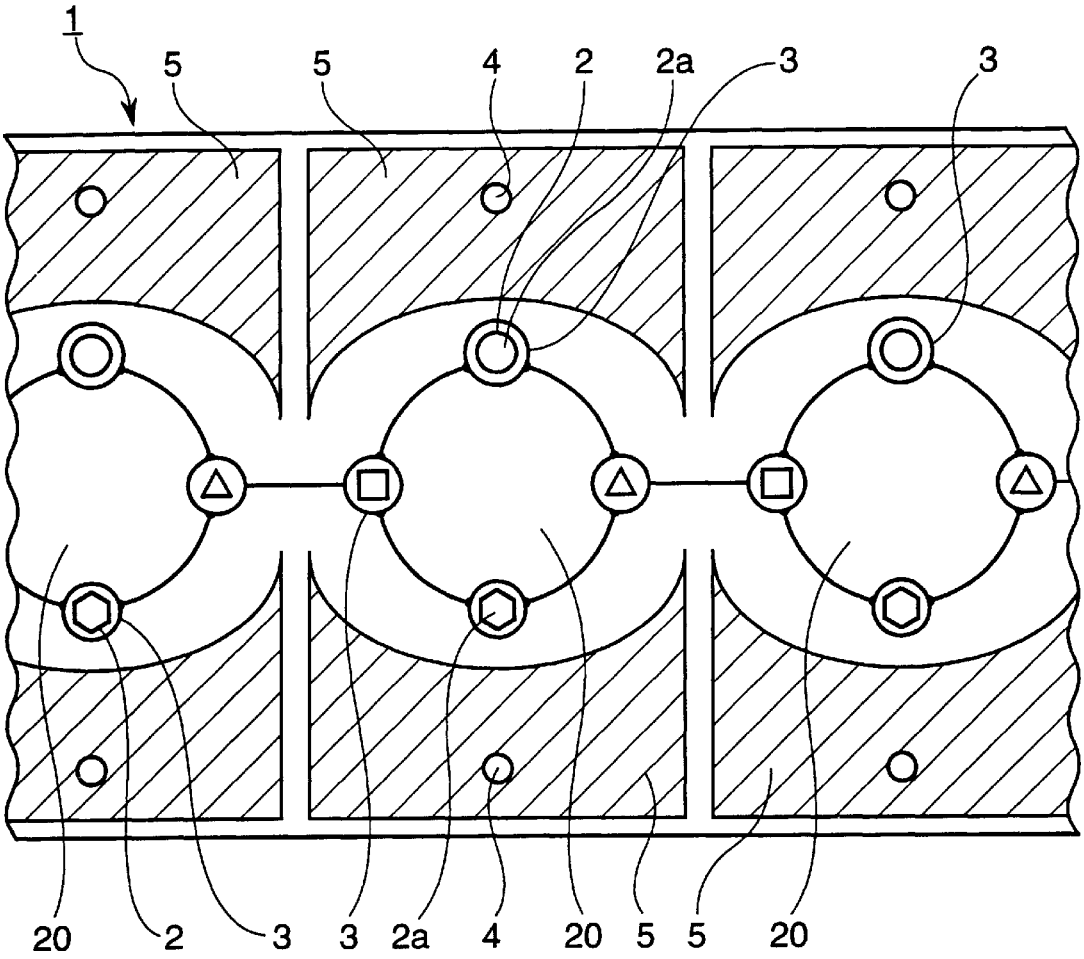
FIG. 1 is a plan view showing a state where electroformed patterns, openings, an electroformed line and an electroformed guide are formed on a surface of a conductive substrate.

In the first place, as shown in FIG. 1, on a surface of a conductive substrate 1 there are formed electroformed patterns 2 of closed line graphic, an electroformed line 3 which surrounds the electroformed patterns 2 and an electroformed guide 5 which surrounds the electroformed patterns 2 and the electroformed line 3 and is provided with guide holes 4. As described below, a coating material is injected or printed inside each of the electroformed patterns 2. Hereinbelow, the part inside each of the electroformed patterns 2 may be referred to as "opening 2*a*".

Figure 2:
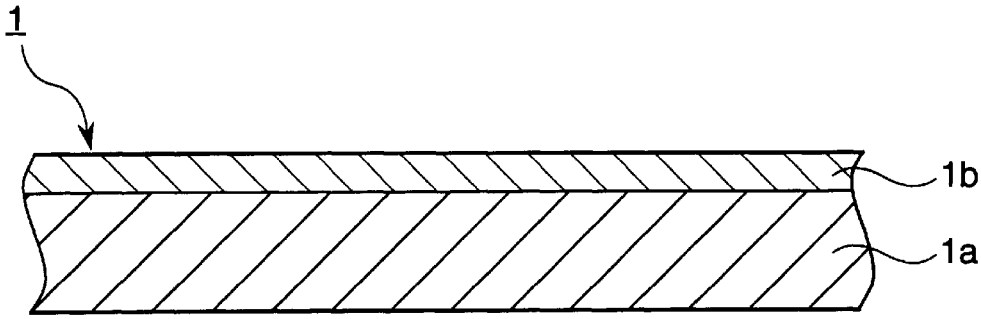
FIG. 2 is a sectional view showing an example of a conductive substrate (multi-layer substrate)

The conductive substrate 1 used herein is, for example, a metallic plate made of a stainless steel or a laminate consisting of a metallic plate 1*a* and a conductive film 1*b* provided on the surface of the metallic plate (hereinafter also referred to as "multi-layer substrate 1") (see FIG. 2). In the present invention, the multi-layer substrate 1 having the conductive film 1*b* on the surface of the metallic plate 1*a* is preferably used as the conductive substrate 1. By the use of such a multi-layer substrate 1 as mentioned above, the electroformed patterns can be prevented from being scattered when the patterns are transferred to a support. In this embodiment, such a case that the multi-layer substrate 1 is used as the conductive substrate is described.

The conductive film 1*b* of the multi-layer substrate 1 is a flexible thin film having electrical conductivity. Employable as the conductive film 1*b* are conductive metallic thin films formed by electroplating (electrodeposition) or electroless plating, conductive paint films, conductive polymer thin films, etc. Of these, preferred use is made of conductive metallic thin films formed by electrodeposition. There is no specific limitation on the thickness of the conductive film 1*b*, but the conductive film 1*b* usually has a thickness of about 10 to 50 $\mu$m, preferably, about 20 to 30 $\mu$m.

The conductive film 1*b* is peeled off from the surface of the metallic plate 1*a* in the later stage. Therefore, the surface of the metallic plate 1*a* is preferably subjected to release treatment before the formation of the conductive film 1*b*, so as to facilitate peeling of the conductive film 1*b*. The release treatment can be carried out by, for example, oxidizing the surface of the metallic plate 1*a* through anode electrolysis or treating the surface of the metallic plate 1*a* with a surface active agent or the like.

Then, the electroformed patterns of closed line graphic 2 and the electroformed line 3 surrounding the electroformed patterns 2 are formed on the surface of the conductive film 1*b*.

Although each of the electroformed patterns 2 may have the shape of, for example, any of a circle, an ellipse, a polygon such as a triangle or a quadrangle and a star, it is requisite that the electroformed patterns each be composed of a "closed" diagram and, thereinside, have an opening 2*a* surrounded by the electroformed pattern 2 of a closed line graphic configuration. The electroformed patterns 2 and the electroformed line 3 can be formed in accordance with the method described in, for example, Japanese Patent Laid-Open Publication No. 107496/1991. A general method for forming the electroformed patterns 2 and the electroformed line 3 will be described below, which in no way limits the scope of the present invention.

In this method, time indicating marks for a timepiece are adhered as the electroformed patterns to a surface of a timepiece display plate (adherend). First, a negative or positive photomask film 6 for desired electroformed patterns is produced by photographing or printing, as shown in FIG. 3.

Figure 3:
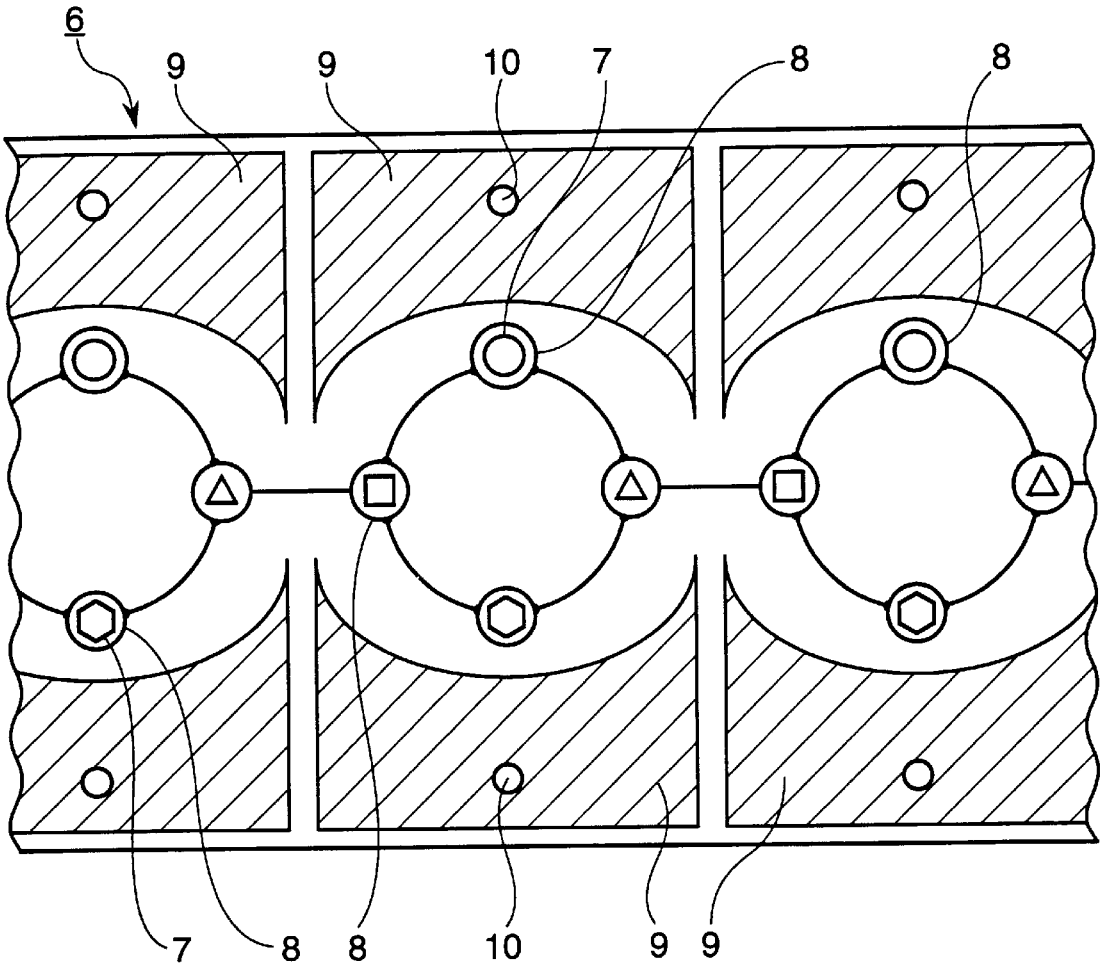
FIG. 3 is a plan view showing an example of a photomask film for electroformed patterns.

The photomask film 6 shown in FIG. 3 is a positive film. On the film 6, target patterns 7 of closed line graphic, a line 8 which surrounds the target patterns 7 and a guide area 9 of rectangular shape which. surrounds the target patterns 7 and the line 8 (i.e., area hatched in FIG. 3) are drawn with black ink or the like. At the predetermined positions inside the guide area 9, guide marks 10 are drawn in white circles. Though the width of the line 8 depends upon the shapes of the target patterns 7 and the sizes thereof, it is usually in the range of about 0.5 to 5 mm. The distance between the target patterns 7 and the line 8 is usually in the range of 0.3 to 0.5 mm.

Figure 4:
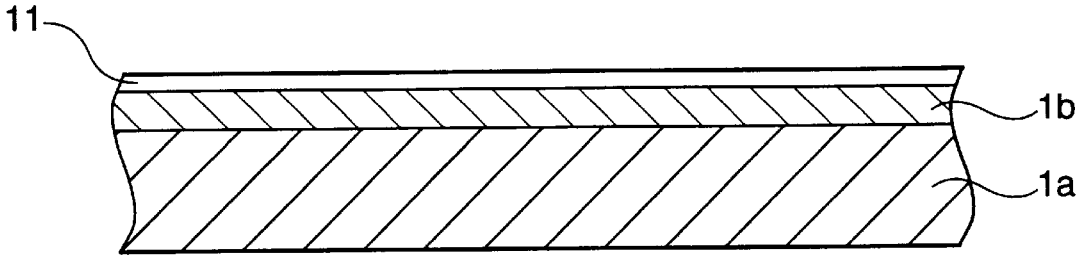
FIG. 4 is a sectional view showing a state where a photoresist is laminated on a surface of a conductive substrate.

Separately, the upper surface of the conductive film 1*b* of the multi-layer substrate 1 is coated with a photoresist 11 such as a liquid resist, a dry film resist or a printing ink resist, and baked, as shown in FIG. 4.

Figure 5:
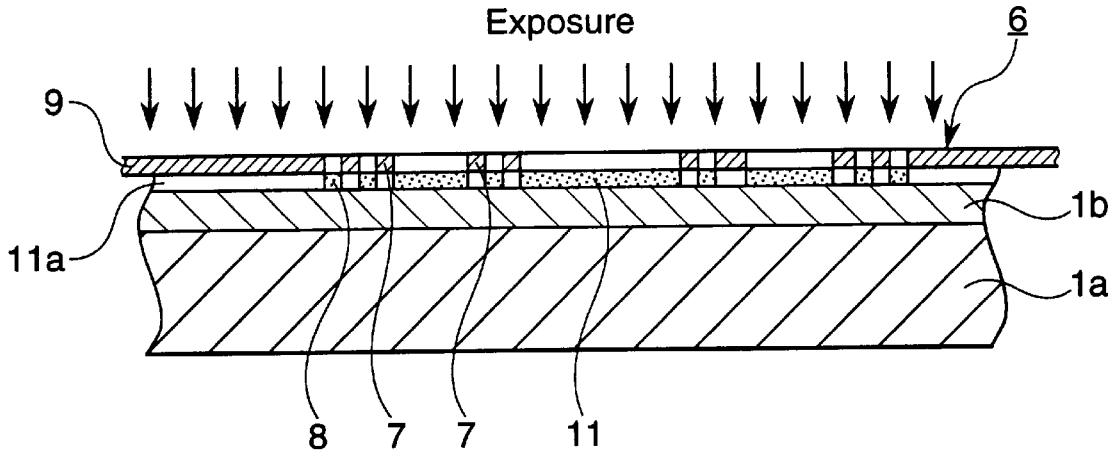
FIG. 5 is a sectional view showing a state where exposure is carried out.

Subsequently, the aforesaid film 6 is placed on the conductive film 1*b* in such a manner that the photoresist 11 is interposed therebetween, and they are exposed to light in this state by the use of an exposure machine, etc., as shown in FIG. 5. In this figure, the portions hatched in the film 6 correspond to those of the target patterns 7, the line 8 and the guide area 9, which block the passage of light.

Figure 6:
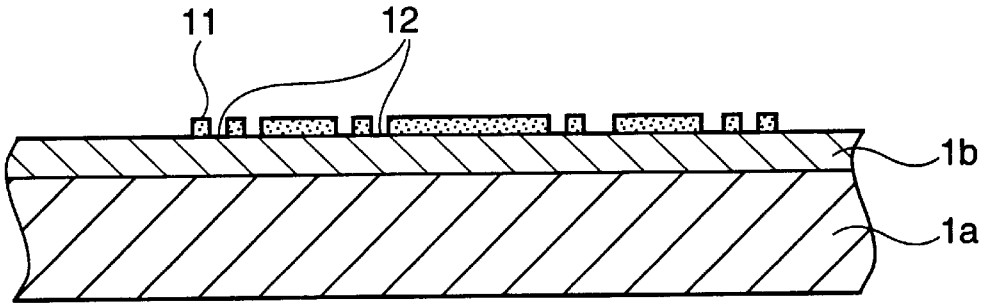
FIG. 6 is a sectional view showing a state where development is carried out after exposure.

After the exposure, development is carried out to remove unexposed portions of the photoresist 11*a* (see FIG. 5), whereby conductive portions 12 (also referred to as "electroformed pattern-corresponding areas") having shapes corresponding to the shapes of the target patterns 7, the line 8 and the guide area 9 are formed on the surface of the conductive film 1*b*, as shown in FIG. 6. Then, if desired, the surfaces of the conductive portions 12 (electroformed pattern-corresponding areas) are subjected to release treatment. If the release treatment is conducted, electroformed patterns 2 and an electroformed line 3, both of which are produced later, can be easily separated from the conductive film 1*b*. This release treatment is carried out in the same manner as described above.

Figure 7:
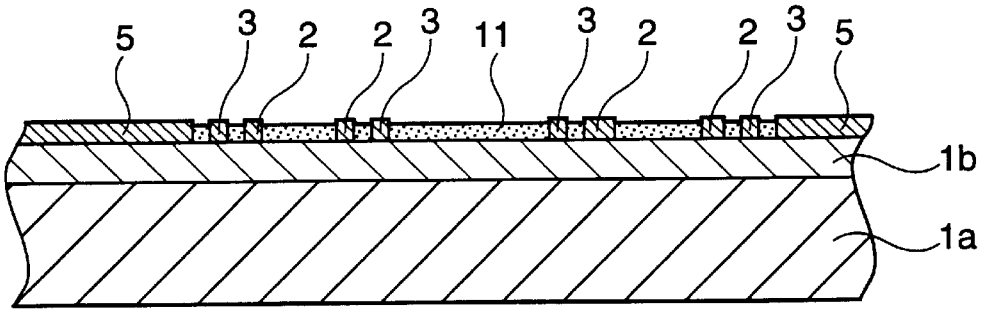
FIG. 7 is a sectional view showing a state where electroforming is carried out after development.

Then, referring to FIG. 7, a metal is deposited on the conductive portions 12 by the electrodeposition technique (pattern electroforming technique) to form electroformed patterns 2 having shapes corresponding to the shapes of the target patterns 7, an electroformed line 3 having a shape corresponding to the shape of the line 8 and an electroformed guide 5 having a shape corresponding to the shape of the guide area 9. When the electroformed line 3 is formed around the electroformed patterns 2 in this manner, the metal which would be deposited on the area corresponding to the target patterns 7 can be distributed to the area corresponding to the line 8, so that excessive electroforming at the target patterns 7 can be inhibited. In the case where the target patterns 7 have sharp shapes, the problem has generally been encountered that a metal is excessively deposited on the sharp portions to thereby cause the resultant electroformed patterns to tend to be rounded. According to the present invention, however, the electroformed line 3 is formed to inhibit excessive electroforming at the electroformed patterns 2, and hence electroformed patterns 2 of sharp shapes can be obtained.

The electroformed patterns 2, when seen from the top, each have the shape of a closed line graphic such as a circle, a polygon or a star and have thereinside an opening 2*a* surrounded by the electroformed pattern 2 of closed line graphic. FIG. 7 shows a sectional form of the electroformed patterns 2. Inside the electroformed guide 5, guide holes (not shown) each penetrating along the shape of the guide mark 10 are provided.

The metal for forming the electroformed patterns 2, the electroformed line 3 and the electroformed guide 5 is, for example, nickel. When nickel is used as the metal, nickel is electrodeposited on the conductive portions 12 by the use of a nickel sulfate solution as an electrolytic solution. The electrodeposition conditions are, for example, as follows. The passage of an electric current of 3 $A/dm^2$ based on the electrodeposition effective area of 150 mm×150 mm over a period of 3 hours enables obtaining electroformed patterns of 100 $\mu$m±10 $\mu$m in thickness.

As a matter of course, any optional metals other than nickel, such as gold, silver, copper, iron, platinum and alloys thereof, can be deposited on the conductive portions 12 to form the electroformed patterns. Further, the electrodeposition conditions can be varied, whereby electroformed patterns having a desired thickness in the range of 20 to 300 $\mu$m can be obtained.

Figure 8:
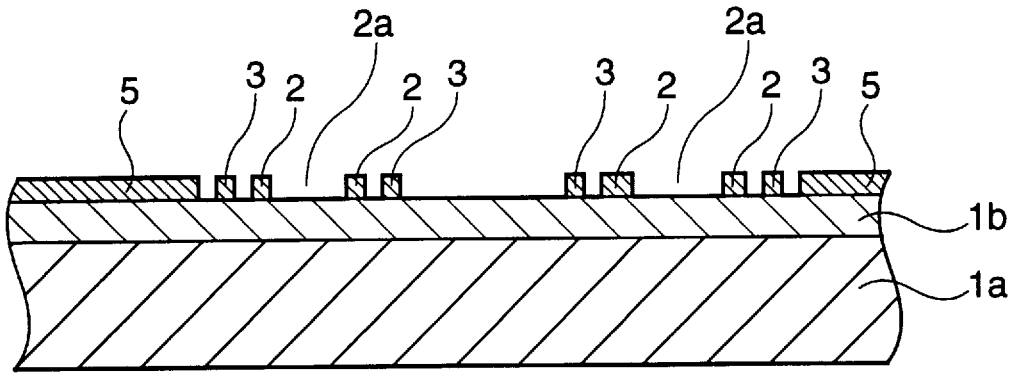
FIG. 8 is a sectional view showing a state where a photoresist is removed after electroforming.

In the next place, the photoresist 11 on the conductive film 1*b* is removed by immersing them in a stripping solution as shown in FIG. 8, whereby the electroformed patterns 2 of closed line graphic having openings 2*a*, the electroformed line 3 which surrounds the electroformed patterns 2 and the electroformed guide 5 which surrounds the electroformed patterns 2 and the electroformed line 3 and is provided with guide holes 4 are formed on the surface of the conductive substrate 1, as shown in FIG. 1. If desired, the surfaces of the electroformed patterns 2 can be subjected to surface treatment such as metal plating or decoration (coloring) treatment such as electrodeposition painting, spray painting, printing, electrostatic painting and vacuum deposition.

Figure 9:
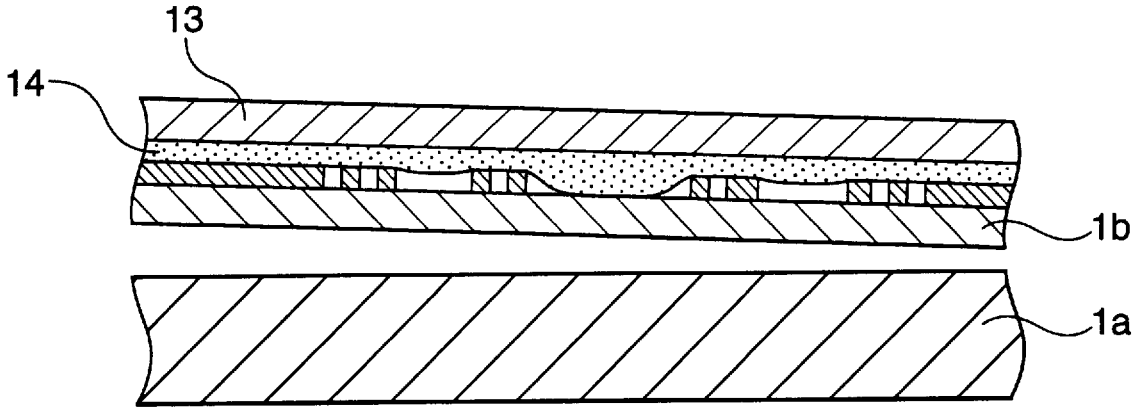
FIG. 9 is a sectional view showing a state where electroformed patterns together with conductive films are transferred to a support and retained thereon.

After the electroformed patterns 2, the electroformed line 3 and the electroformed guide 5 are formed on the surface of the conductive substrate 1 by the electroforming as described above, these electroformed portions are transferred to a pressure-sensitive adhesive layer 14 of a support 13 such as a film as shown in FIG. 9. When the multi-layer substrate 1 is used, the electroformed patterns are formed on the conductive film 1*b*, and in this case, the conductive film 1*b* is peeled off simultaneously with the transferring of the electroformed patterns. In more detail, interfacial separation between the conductive film 1*b* and the metallic plate 1*a* is carried out, and the electroformed patterns are separated while the patterns are interposed between the conductive film 1*b* and the support 13. As a result, scattering of the electroformed patterns is inhibited, and thereby the electroformed patterns can be manufactured in high yields. Further, the electroformed patterns and the metallic plate can be released with almost no deformation. Therefore, any stress does not remain in the electroformed patterns and any deformation does not take place after adhesion of the patterns to the adherend. Moreover, there is such an advantage that the metallic plate can be subjected to repeated uses. If a film of high surface smoothness, e.g., electro-plate film (electrodeposit film) is used as the conductive film 1*b*, the resulting electroformed patterns have smooth back surfaces, and hence adhesion of the patterns to the adherend can be reliably carried out. Further, since the photoresist can be closely bonded to the conductive film lb of high surface smoothness, occurrence of flash can be inhibited, and hence electroformed patterns of high quality can be obtained.

The pressure-sensitive adhesive layer 14 can be formed from various pressure-sensitive adhesives, for example, those of ultraviolet-curing type, thermosetting type and hardening-with-time type.

Typical examples of the pressure-sensitive adhesives of ultraviolet-curing type include rubber type or acrylic type pressure-sensitive adhesives compounded with addition-polymerizable compounds having two or more unsaturated bonds or photopolymerizable compounds such as an alkoxysilane having an epoxy group and photopolymerization initiators such as carbonyl compounds, organosulfur compounds, peroxides, amines and onium salt compounds (see Japanese Patent Laid-Open Publication No. 196956/1985). The photopolymerizable compound and the photopolymerization initiator are generally added in amounts of 10 to 500 parts by weight and 0.1 to 20 parts by weight, respectively, each based on 100 parts by weight of the base polymer.

Examples of the acrylic type polymers used herein include those conventionally employed (see Japanese Patent Laid-Open Publication Nos. 54068/1982 and 33909/1983), those having radical reactive unsaturated groups on the side chain (see Japanese Patent Publication No. 56264/1986) and those having epoxy groups in the molecule.

Examples of the addition-polymerizable compounds having two or more unsaturated bonds include polyhydric alcohol esters of acrylic acids and methacrylic acids, oligoesters of these acids, epoxy compounds and urethane compounds.

Epoxy group functional crosslinking agents having at least one epoxy group in the molecule, such as ethylene glycol diglycidyl ether, may be further added to increase crosslinking effect.

In the case where the pressure-sensitive adhesive layer 14 is formed by the use of the ultraviolet-curing type adhesive, it is necessary to use a transparent film as the support 13 so that the ultraviolet irradiation can be performed.

Typical examples of the pressure-sensitive adhesives of thermosetting type include rubber type pressure-sensitive adhesives or acrylic type pressure-sensitive adhesives compounded with crosslinking agents such as polyisocyanates, melamine resins, amine-epoxy resins, peroxides and metal chelate compounds; if desired, together with crosslinking modifiers of polyfunctional compounds such as divinylbenzene, ethylene glycol diacrylate and trimethylolpropane trimethacrylate.

The pressure-sensitive adhesive of hardening-with-time type is, for example, an adhesive whose adhesive force is decreased by evaporation of the solvent with time.

Figure 10:
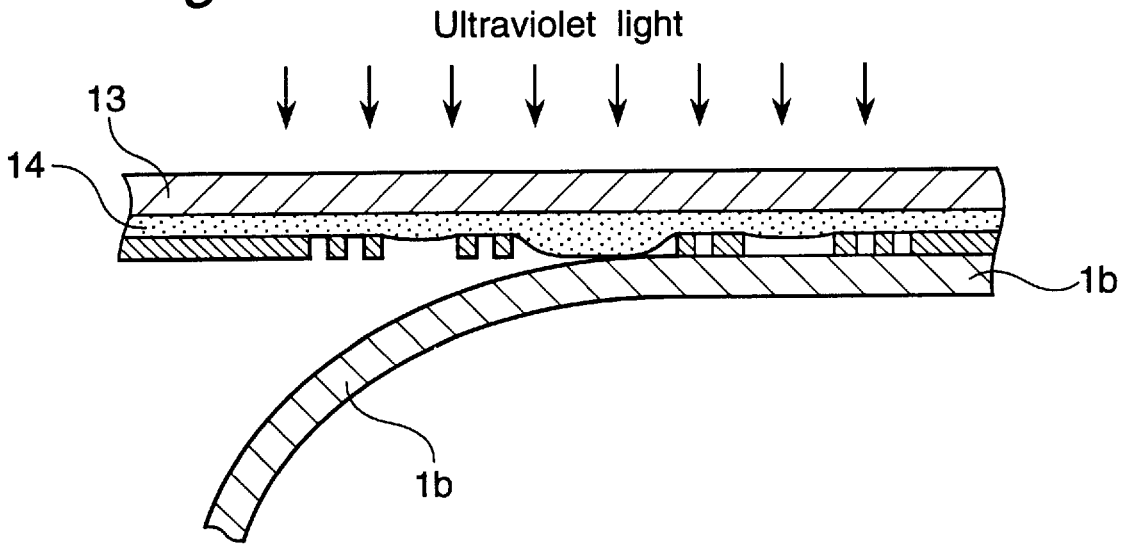
FIG. 10 is a sectional view showing a state where a conductive film is removed after irradiation with a small amount of ultraviolet light.

After the electroformed patterns, etc. (2, 3, 5) are transferred together with the conductive thin film 1*b* on the pressure-sensitive adhesive layer 14 of the support 13, the conductive thin film 1*b* is removed to expose the electroformed patterns, etc. outside (this exposed surface is also referred to as "whole surface of the side where the electroformed patterns, etc. are retained" hereinafter), as shown in FIG. 10. When the pressure-sensitive adhesive layer 14 is formed from the ultraviolet-curing type pressure-sensitive adhesive, it is preferred to decrease the adhesive force of the pressure-sensitive adhesive layer 14 by irradiating the adhesive layer 14 with a small amount of ultraviolet light prior to the removal of the conductive thin film 1*b*. Further, prior to the separation between the metallic plate 1*a* and the conductive thin film 1*b* (see FIG. 9), the adhesive force of the pressure-sensitive adhesive layer 14 can be decreased. The reason is that the adhesive force of the ultraviolet curing type pressure-sensitive adhesive is so strong, e.g., 2,400 g/25 mm-width that, unless the adhesive force is decreased to a certain extent, the conductive thin film 1*b* is hardly separated from the pressure-sensitive adhesive layer 14. However, excessive decrease of the adhesive force of the ultraviolet-curing type adhesive layer is unfavorable, because the electroformed patterns are also peeled off when the conductive thin film 1*b* is removed. Accordingly, the adhesive force of the pressure-sensitive adhesive layer after the irradiation with ultraviolet light is desired to be in the range of about 300 to 600 g/25 mm-width, especially, about 400 to 500 g/25 mm-width.

Figure 11:
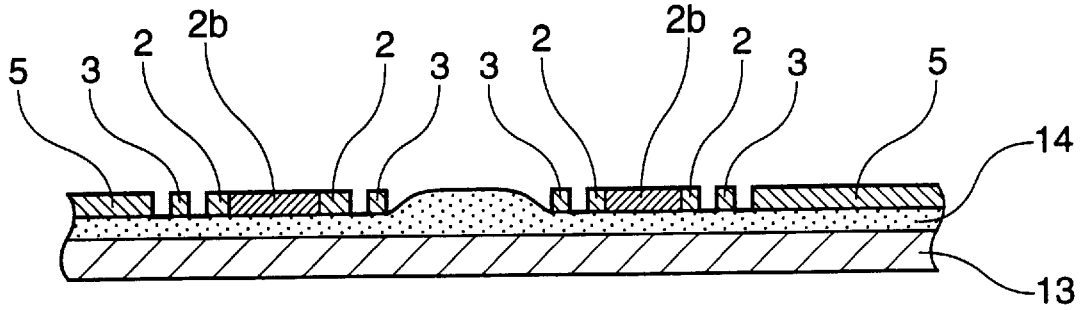
FIG. 11 is a sectional view showing a state where a coating material has been injected or printed inside an opening.

Now, referring to FIG. 11, a coating material is injected or printed inside the electroformed patterns 2 of closed line graphic (opening 2*a*), from which coating films 2*b* is formed.

Various common coating materials such as a luminous paint and a fluorescent paint can be used without any limitation as the above coating material. In particular, the use of a luminous paint or a fluorescent paint is preferred and the use of a luminous paint is especially preferred when the electroformed patterns 2 are employed as pointers or time indicating marks for timepieces.

The luminous paint, when irradiated with light, absorbs its energy and emits phosphorescence in the dark. The emission of phosphorescence is realized by the use of powdery phosphor as a pigment. The phosphor is composed of, for example, zinc sulfide or an alkaline earth sulfide. The incorporation of an extremely small amount of heavy metal known as an activator is inevitable for the emission of phosphorescence from the above sulfide. Apart from the luminous paint composed mainly of the above sulfide, another luminous paint is also known which consists of, for example, $MAl_2O_4$ (M is an element selected from among Ca, Sr and Ba) and a heavy metal.

The fluorescent paint absorbs ultraviolet which is not perceptible to vision, converts it to light which is perceptible to vision and reflects the visible light. The fluorescent paint can be obtained by the use of a fluorescent pigment. Various known organic and inorganic fluorescent substances can be used as the fluorescent pigment.

In the present invention, various conventional luminous paints, fluorescent paints and other common paints can be used without any particular limitation as the coating material.

Although the method of incorporating the above coating material is not particularly limited, an ink injector is preferably used which is capable of injecting the coating material at a constant pressure. The use of this injector enables forming coating films 2*b* which has excellent surface smoothness.

Further, the method of printing the coating material is not particularly limited, and any of conventional printing techniques such as the silk printing, the screen printing and the gravure printing can be employed.

The thickness of the coating film 2*b* can appropriately be regulated by controlling the viscosity of the coating material or repeating the injection or printing of the coating material. For example, a coating film 2*b* whose thickness is as relatively large as about 100 to 500 $\mu$m can be produced. Therefore, even if a luminous paint is used, a satisfactorily high phosphorescence and a satisfactorily long life can be ensured.

The thus formed coating film 2*b* can be retained by the firmly bonding adhesive layer 15 described hereinbelow and securely adhered to an adherend.

Figure 12:
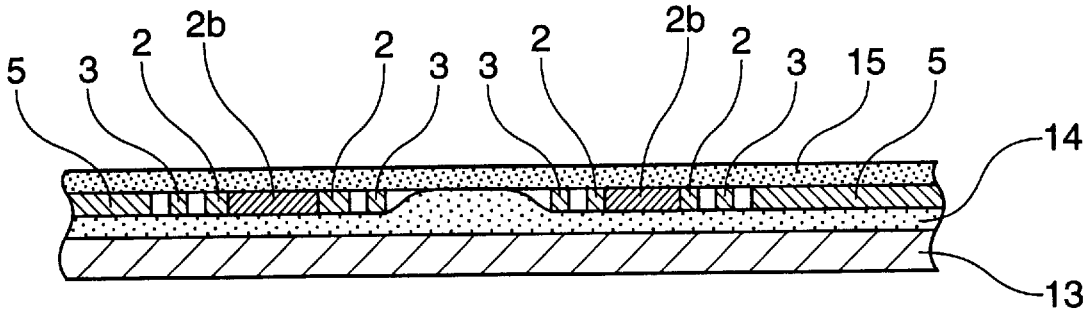
FIG. 12 is a sectional view showing a state where a firmly bonding adhesive layer is formed on a whole surface of the support on its side where the electroformed patterns, the coating films, the electroformed line and the electroformed guide are retained.
Figure 13:
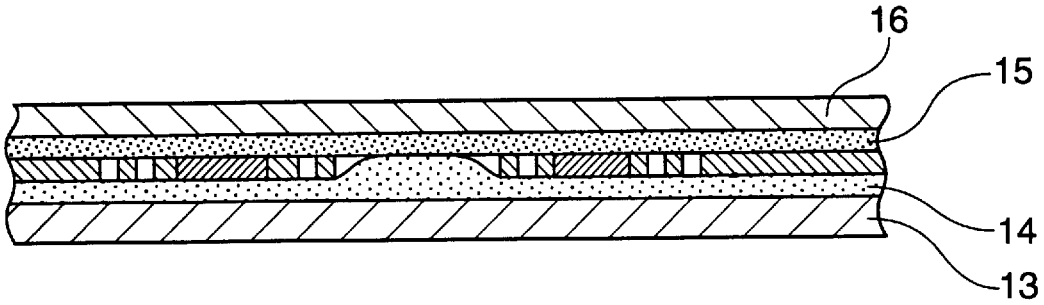
FIG. 13 is a sectional view showing a state where a release paper is attached to the firmly bonding adhesive layer.

Subsequently, as shown in FIG. 12, a firmly bonding adhesive layer 15 is formed on the whole surface of the side where the electroformed patterns 2, the coating films 2*b*, the electroformed line 3 and the electroformed guide 5 are retained. The firmly bonding adhesive layer 15 preferably has an adhesive force higher than the pressure-sensitive adhesive layer 14. Thereafter, a release paper 16 is attached onto the firmly bonding adhesive layer 15 (see FIG. 13). In this state, the adhesive force of the pressure-sensitive adhesive layer 14 is further decreased.

Figure 14:
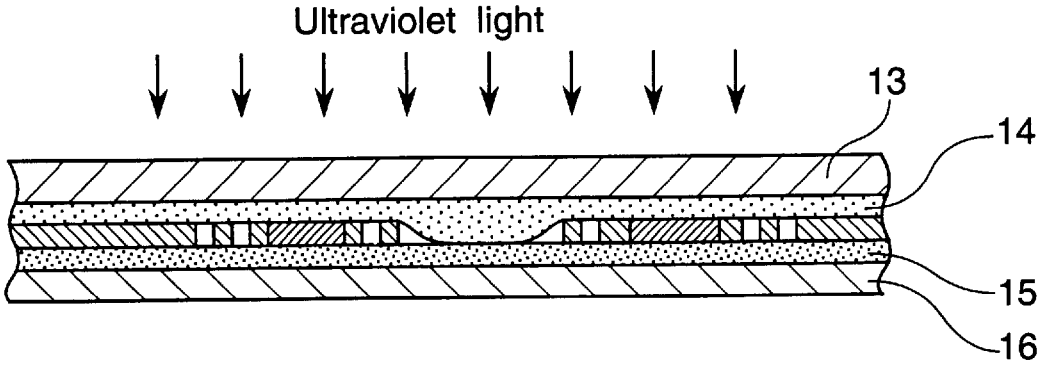
FIG. 14 is a sectional view showing a state where the adhesive force of a pressure-sensitive adhesive layer is decreased by irradiation with ultraviolet light.

In the case where the pressure-sensitive adhesive layer 14 is formed from the ultraviolet-curing type pressure-sensitive adhesive, after the release paper 16 is attached, the support 13 is irradiated with ultraviolet light from the surface side of the electroformed patterns, i.e., the opposite side to the side where the electroformed patterns are retained, as shown in FIG. 14, to thereby alter the adhesive force of the pressure-sensitive adhesive layer 14 to extremely weak one.

In the case where the pressure-sensitive adhesive layer 14 is formed from the thermosetting type pressure-sensitive adhesive, the adhesive force of the pressure-sensitive adhesive layer 14 is altered to extremely weak one by heating the support 13. In the case where the pressure-sensitive adhesive layer 14 is formed from the hardening-with-time type pressure-sensitive adhesive, the adhesive force of the pressure-sensitive adhesive layer 14 is altered to extremely weak one by allowing the adhesive layer 14 to stand for a certain period of time.

It is desired that the adhesive force of the pressure-sensitive adhesive layer 14 be decreased to 100 g/25 mm width or less, especially, about 30 to 50 g/25 mm-width by the above treatment.

Figure 15:
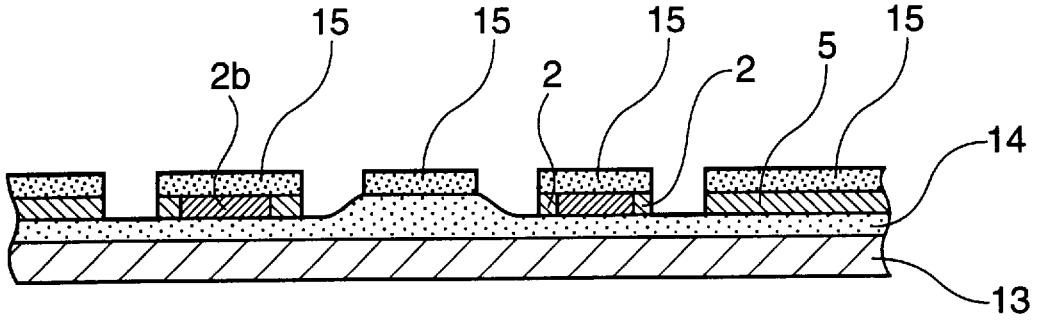
FIG. 15 is a sectional view showing a state where the electroformed line and the electroformed island are removed.
Figure 16:
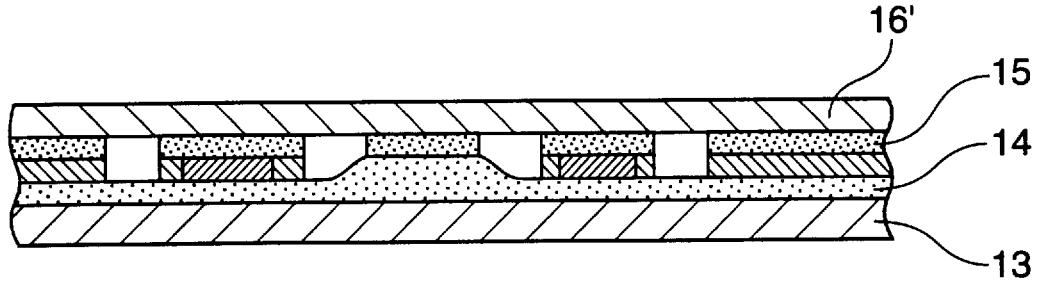
FIG. 16 is a sectional view showing a state where a release paper is attached to the firmly bonding adhesive layer after removal of the electroformed line and the electroformed island.

Subsequently, the release paper 16 is removed. Then, the electroformed line 3 is removed, as shown in FIG. 15. The electroformed line 3 is a continuous line as shown in FIG. 1, and it can be removed at a time. As a result, the electroformed line 3 which is located near the electroformed patterns is removed together with the firmly bonding adhesive 15, and hence the firmly bonding adhesive hardly remains near around the electroformed patterns. Accordingly, the electroformed patterns 2 and the coating films 2*b* can be easily separated from the support 13, and protrusion of the adhesive after adhering the electroformed patterns to the adherend can be inhibited. Unless the electroformed patterns are subjected to an immediate use, a release paper 16' is attached to the firmly bonding adhesive layer 15 side of the electroformed patterns as shown in FIG. 16, and the release paper 16' is peeled off before use.

Figure 17:
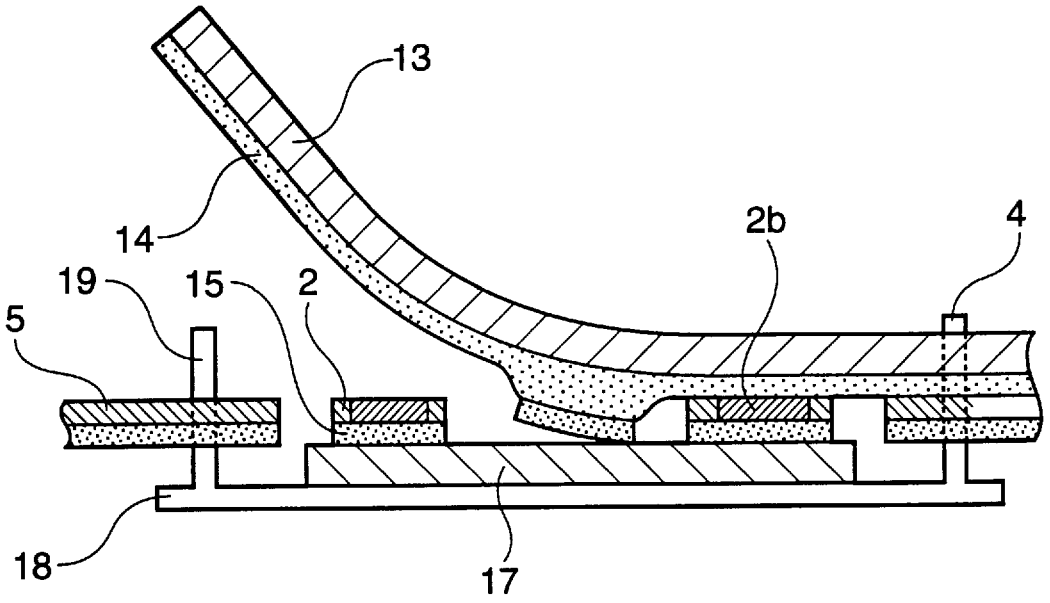
FIG. 17 is a sectional view showing a state where the electroformed patterns and the coating films are transferred to an adherend simultaneously with separating the electroformed patterns and the coating films from the support.

Then, as shown in FIG. 17, the electroformed patterns 2 and the coating films 2*b* are adhered to a surface of an adherend 17 through the firmly bonding adhesive 15 applied on the electroformed patterns 2 and the coating films 2*b*, simultaneously with separating the electroformed patterns 2 and the coating films 2*b* from the support 13.

Figure 18:
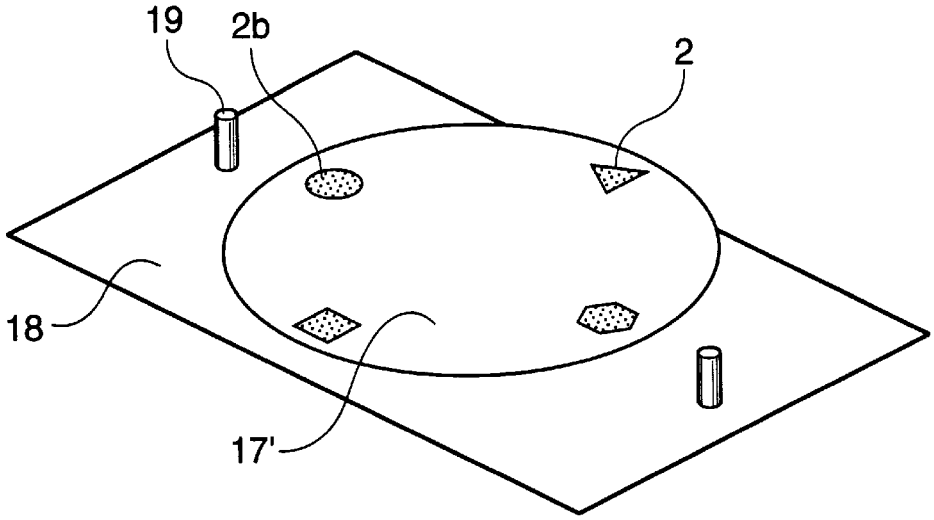
FIG. 18 is a perspective view of an adherend to which the electroformed patterns and the coating films are adhered.

As shown in FIGS. 17 and 18, a holding fixture 18 which holds a timepiece display plate 17' (i.e., adherend 17) is provided with guide pins 19 overhanging from the holding fixture. By virtue of these guide pins 19 and the aforesaid guide holes 4 provided in the electroformed guide 5, positioning of the electroformed patterns 2 and the coating films 2*b* on the timepiece display plate 17' can be carried out.

As described hereinbefore, the adhesive force of the pressure-sensitive adhesive layer 14 is decreased. This is the same situation as the electroformed patterns 2 and the coating films 2*b* are held by a weak adhesive. Accordingly, the electroformed patterns 2 and the coating films 2*b* can be adhered to a surface of the timepiece display plate 17' (adherend) through the firmly bonding adhesive 15 applied on the electroformed pattern-retention side of the support 13, simultaneously with separating the electroformed patterns 2 and the coating films 2*b* from the support 13.

Attaching of the firmly bonding adhesive 15 to the timepiece display plate 17' can be prevented by selecting both adhesives for the pressure-sensitive adhesive layer 14 and the firmly bonding adhesive layer 15 so that the adhesive force at the interface between the pressure-sensitive adhesive layer 14 and the firmly bonding adhesive 15 is made larger than the adhesive force at the interface between the timepiece display plate 17' and the firmly bonding adhesive 15.

For example, when an acrylic type pressure-sensitive adhesive compounded with a photopolymerizable compound and a photopolymerization initiator is used as a pressure-sensitive adhesive for forming the pressure-sensitive adhesive layer 14, the adhesive force at the interface between the pressure-sensitive adhesive layer 14 and the firmly bonding adhesive 15 can be made larger than the adhesive force at the interface between the timepiece display plate 17' and the firmly bonding adhesive 15 by using, as the firmly bonding adhesive 15, an adhesive similar to the pressure-sensitive adhesive for the pressure-sensitive adhesive layer 14 but compounded with no photopolymerizable compound and no photopolymerization initiator, i.e., an acrylic type pressure-sensitive adhesive composed of only an acrylic base polymer, and by, after application thereof, aging the adhesive at 40° C. for 9 hours. Hence, the unnecessary adhesive, i.e., adhesive on the area other than the bonding area, can be completely removed. Such a troublesome operation as coating only the back surfaces of the electroformed patterns with the adhesive can be omitted by selecting both the adhesives so that the bonding force at the interface between the pressure-sensitive adhesive layer 14 having been reduced in the adhesion and the firmly bonding adhesive 15 is made larger than the bonding force at the interface between the adherend 17 and the firmly bonding adhesive 15 as described above. As a result, the process can be simplified.

In the present invention, the adhesive may be applied by coating or spraying through a mask having openings slightly larger than the electroformed patterns 2 in the formation of the firmly bonding adhesive layer 15, whereby the firmly bonding adhesive layer 15 can be formed on only the back surfaces of the electroformed patterns 2 and the coating films 2*b*.

The first embodiment of the present invention has been described referring mainly to the method of manufacturing a timepiece display plate as an illustrative example. In this connection, the timepiece display plate has a large blank portion at a center thereof (wherein the terminology "blank portion" means the portion surrounded by the electroformed line 3 but the area other than the electroformed patterns 2 and the openings 2*a*, and is indicated by numeral "20" in FIG. 1). However, if the photoresist corresponding to the blank portion 20 (for example, indicated by numeral "11" as in FIG. 5) has a pinhole, an electrodeposit occurs at the pinhole to thereby form a small electroformed product at the blank portion 20. When the above small electroformed product is transformed to the timepiece display plate, the appearance thereof is markedly spoiled.

Figure 19:
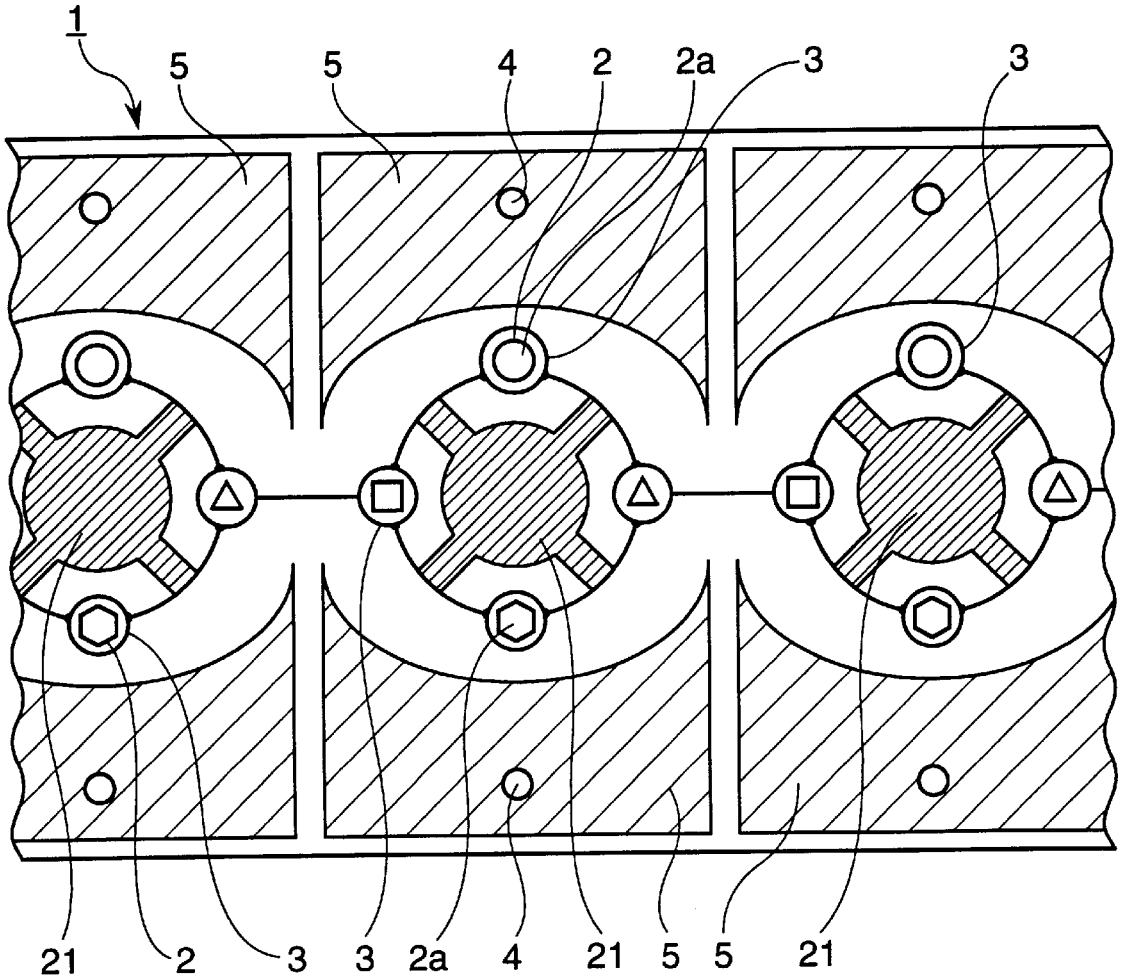
FIG. 19 is a plan view showing a state wherein electroformed patterns, openings, an electroformed line, an electroformed guide and an electroformed island are formed on a surface of a conductive substrate.

The second process for manufacturing electroformed patterns according to the present invention is intended to inhibit the formation of small electroformed products at the blank portion 20. The second embodiment of the present invention is similar to the first embodiment except for forming an electroformed island 21 at the blank portion 20 (see FIG. 19). The electroformed island 21 is interlinked with and surrounded by the electroformed line 3, and formed at portion other than the electroformed patterns 2.

The electroformed island 21 is provided at the center of the blank portion 20, and desirably formed at an area ratio of about 40% to 70%, preferably, about 50% to 60% based on the whole area of the blank portion 20.

The second process for manufacturing electroformed patterns according to the present invention comprises the steps of:

forming electroformed patterns 2 of closed line graphic having openings 2*a*, an electroformed line 3 surrounding the above patterns and an electroformed island 21 arranged at area other than that of the above electroformed patterns, the above electroformed island being surrounded by and interlinked to the above electroformed line, on a surface of a conductive substrate peeling the electroformed patterns 2, the electroformed line 3 and the electroformed island 21 from the conductive substrate 1 to transfer them onto a pressure-sensitive adhesive layer 14 provided on a support 13, injecting or printing a coating material inside the openings 2*a* surrounded by the electroformed patterns 2 of closed line graphic and converting the coating material to coating films 2*b*, forming a firmly bonding adhesive layer 15 on a whole surface of the support on its side where the electroformed patterns 2, the coating films 2*b*, the electroformed line 3 and the electroformed island 21 are retained, removing the electroformed line 3 and the electroformed island 21, separating the electroformed patterns 2 and the coating films 2*b* from the support 13 and, simultaneously therewith, adhering the electroformed patterns 2 and coating films 2*b* through the firmly bonding adhesive layer 15 onto a surface of an adherend 17.

By providing the above electroformed island 21, the occurrence of small electroformed products can be inhibited at the blank portion 20. Further, the electroformed island 21 is interlinked with the electroformed line 3, and hence the electroformed island 21 is readily removed together with the electroformed line 3. Furthermore, the strength of the electroformed line 3 is increased by the electroformed island 21, so that cutting-off of the electroformed line 3 can be inhibited when removing the electroformed line 3.

EFFECT OF THE INVENTION

The manufacturing of electroformed patterns provided with coating films for which high expertise has been required can be accomplished by the present invention at a lowered cost. Further, when the electroformed patterns are adhered to an adherend, the patterns can be easily separated from the support, and protrusion of the adhesive after adhering the electroformed patterns to the adherend can be inhibited. Moreover, according to the present invention, the occurrence of pinhole-like small electroformed products can be inhibited.

What is claimed is:

1. A process for manufacturing electroformed patterns, comprising:

forming electroformed closed line graphic patterns and an electroformed line surrounding said patterns on a surface of a conductive substrate, peeling the electroformed patterns and the electroformed line from the conductive substrate to transfer them onto a pressure-sensitive adhesive layer provided on a support, injecting or printing a coating material inside the closed line graphic electroformed patterns and converting the coating material to coating films, forming a firmly bonding adhesive layer on a whole surface of the support on its side where the electroformed patterns, the coating films and the electroformed line are retained, removing the electroformed line, a separating the electroformed patterns and the coating films from the support and, simultaneously therewith, adhering the electroformed patterns and coating films through the firmly bonding adhesive layer onto a surface of an adherend.

2. The process for manufacturing electroformed patterns as claimed in claim 1, wherein the conductive substrate comprises a metallic plate and a conductive thin film provided thereon.

3. A process for manufacturing electroformed patterns as claimed in claim 2, wherein the coating material injected or printed inside the closed line graphic electroformed patterns is a luminous paint.

4. The process for manufacturing electroformed patterns as claimed in claim 1, wherein the pressure-sensitive adhesive layer comprises an ultraviolet-curing pressure-sensitive adhesive.

5. A process for manufacturing electroformed patterns as claimed in claim 4, wherein the coating material injected or printed inside the closed line graphic electroformed patterns is a luminous paint.

6. The process for manufacturing electroformed patterns as claimed in claim 1, wherein the coating material injected or printed inside the closed line graphic electroformed patterns is a luminous paint.

7. A process for manufacturing electroformed patterns, comprising:

forming electroformed closed line graphic patterns an electroformed line surrounding said patterns and an electroformed island arranged at an area other than that of said electroformed patterns, said electroformed island being surrounded by and interlinked to said electroformed line, on a surface of a conductive substrate, peeling the electroformed patterns, the electroformed line and the electroformed island from the conductive substrate to transfer them onto a pressure-sensitive adhesive layer provided on a support, injecting or printing a coating material inside the closed line graphic electroformed patterns and converting the coating material to coating films, forming a firmly bonding adhesive layer on a whole surface of the support on its side where the electroformed patterns, the coating films, the electroformed line and the electroformed island are retained, removing the electroformed line and the electroformed island, separating the electroformed patterns and the coating films from the support and, simultaneously therewith, adhering the electroformed patterns and coating films through the firmly bonding adhesive layer onto a surface of an adherend.

8. The process for manufacturing electroformed patterns as claimed in claim 7, wherein the conductive substrate comprises a metallic plate and a conductive thin film provided thereon.

9. A process for manufacturing electroformed patterns as claimed in claim 8, wherein the coating material injected or printed inside the closed line graphic electroformed patterns is a luminous paint.

10. The process for manufacturing electroformed patterns as claimed in claim 7, wherein the pressure-sensitive adhesive layer comprises an ultraviolet-curing type pressure-sensitive adhesive.

11. A process for manufacturing electroformed patterns as claimed in claim 10, wherein the coating material injected or printed inside the closed line graphic electroformed patterns is a luminous paint.

12. A process for manufacturing electroformed patterns as claimed in claim 7, wherein the coating material injected or printed inside the closed line graphic electroformed patterns is a luminous paint.

* * * * *

UNITED STATES PATENT AND TRADEMARK OFFICE

CERTIFICATE OF CORRECTION

PATENT NO. : 5,891,285

DATED : April 6, 1999

INVENTOR(S) : Hajime Nakayama

It is certified that error appears in the above-identified patent and that said Letters Patent is hereby corrected as shown below:

Column 1 Lines 18-19 "electrode-positing" should read --electro-depositing--.

Column 1 Lines 55-56 "on surface" should read --on a surface--.

Column 4 Line 55 between "which" and "surrounds" delete period --.--.

Column 8 Line 59 delete "alter" and insert --extremely weaken--.

Column 8 Line 60 delete "to extremely weak one".

Column 10 Line 61 after "substrate" insert --1,--.

Column 11 Line 56 Claim 1 before "separating" delete --a--.

Column 12 Line 18 Claim 7 after "graphic patterns" insert comma --,--.

Column 12 Line 55 Claim 10 after "ultraviolet-cuting" delete --type--.

UNITED STATES PATENT AND TRADEMARK OFFICE

CERTIFICATE OF CORRECTION

PATENT NO. : 5,891,285

DATED : 4/6/99

INVENTOR(S) : Nakayama

It is certified that error appears in the above-identified patent and that said Letters Patent is hereby corrected as shown below:

Column 8, line 59, delete "alter" and insert --extremely weaken--

Column 8, line 60, delete "to extremely weak one".

Signed and Sealed this

Eleventh Day of April, 2000

*Attest:*

*Attesting Officer*

Q. TODD DICKINSON

*Director of Patents and Trademarks*